United States Patent [19]

Bogner et al.

[11] Patent Number: 4,493,196

[45] Date of Patent: Jan. 15, 1985

[54] RING CONSTRUCTION AND METHOD OF MAKING SAME

[76] Inventors: Max Bogner, 291 Henry St., Paramus, N.J. 07652; Larry Grun, 64 Cricket Dr., Roslyn, N.Y. 11576

[21] Appl. No.: 532,551

[22] Filed: Sep. 15, 1983

[51] Int. Cl.[3] ..... A44C 9/00

[52] U.S. Cl. ..... 63/15; 29/160.6

[58] Field of Search ..... 63/15, 2, 3; 29/160.6, 29/8

[56] References Cited

U.S. PATENT DOCUMENTS

| | | | |
|---|---|---|---|
| 217,453 | 6/1979 | Downs . | |
| 921,759 | 5/1909 | Walker | 63/15 UX |
| 1,431,652 | 10/1922 | Grossman | 29/8 |
| 1,933,576 | 11/1933 | Weed . | |
| 1,935,504 | 11/1933 | Hargreaves . | |
| 1,983,348 | 12/1934 | Dieges . | |
| 2,050,253 | 8/1936 | Bager | 63/15 |
| 2,054,408 | 9/1936 | Casey . | |
| 2,332,344 | 10/1943 | Roskin | 63/15 |
| 4,317,264 | 3/1982 | Bogner | 29/8 |

FOREIGN PATENT DOCUMENTS

| | | | |
|---|---|---|---|
| 208883 | 8/1956 | Australia . | |
| 533342 | 12/1954 | Belgium | 63/2 |

*Primary Examiner*—F. Barry Shay

*Attorney, Agent, or Firm*—Charles E. Temko

[57] ABSTRACT

An improved ring construction suitable for rings, bracelets and similar articles of jewelry, in which a metallic braided decorative strip is underpinned to the outer surface of the ring so that the end and side edgings are shielded from accidental contact during wearing by a user. The ends of the braided strip are enclosed beneath a covering lip forming a part of the ring at each end thereof, while the side edges are covered by planar circular plates soldered to the body of the ring.

4 Claims, 4 Drawing Figures

RING CONSTRUCTION AND METHOD OF MAKING SAME

BACKGROUND OF THE INVENTION

This invention relates generally to the field of jewelry, and more particularly to an improved decorative ring or bracelet of a type in which a metallic braided strip of known type is secured to an outer surface of the annular part of the ring body to substantially surround the same. Rings of this general type are well known in the art and the invention lies in specific constructional details and a method of forming the ring which provides a distinctive appearance, and, more importantly, improved durability.

It is known, for example, to form an annular portion of a ring base, the edges of which are folded around the edges of the braided strip to cover the edges as taught by the Casey U.S. Pat. No. 2,054,408. This construction requires a relatively thin main body which is not resistant to damage during use.

The U.S. Pat. No. 1,983,348 to Dieges, teaches a fragmented ring employing a flattened chain to form part of the annular body of the ring, the chain being anchored to an exposed gem mounting portion. Such construction is not suitable for use with a relatively thin braided decorative strip, but requires a chain of substantial mechanical strength.

The U.S. Pat. No. 1,935,504 to Hargreaves, teaches a three piece composite construction in which the braided member is sandwiched between a pair of solid members, one of which is orificed to provide a view of the braided member. This construction is suitable only for bracelets. A similar construction is disclosed in the Weed pattern, U.S. Pat. No. 1,933,576.

The Australian Pat. No. 208,883 discloses a ring body of C-shaped cross sections having an inlay in the recess formed thereby. In this case, both elements are formed from sheet metallic stock and the ring construction does not lend itself to a wide variety of designs.

The principal shortcoming of the great bulk of the prior art is that it is not relatively adaptable to cast ring constructions of the type used, for example, in engagement rings and the like, wherein the annular main body portion is formed integrally with the setting for a gem stone.

SUMMARY OF THE INVENTION

Briefly stated, the invention contemplates the provision of an improved cast ring construction which integrates a decorative braided metallic strip of very thin configuration, and in which all of the exposed side and end edges are effectively concealed and protected during normal use. The construction is particularly suited to that type of ring which includes a gem stone supported in a mounting, the braided strip coming to and terminating on either side of the gem stone support bridge. A lip is provided to cover each end of the braided strip adjacent to the bridge mounting. Side plates of diameters substantially equal to the outer diameter of the braided strip are soldered to the base ring to overly the exposed side edges of the base ring and the decorative strip, leaving only the outer surface of the decorative strip exposed.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
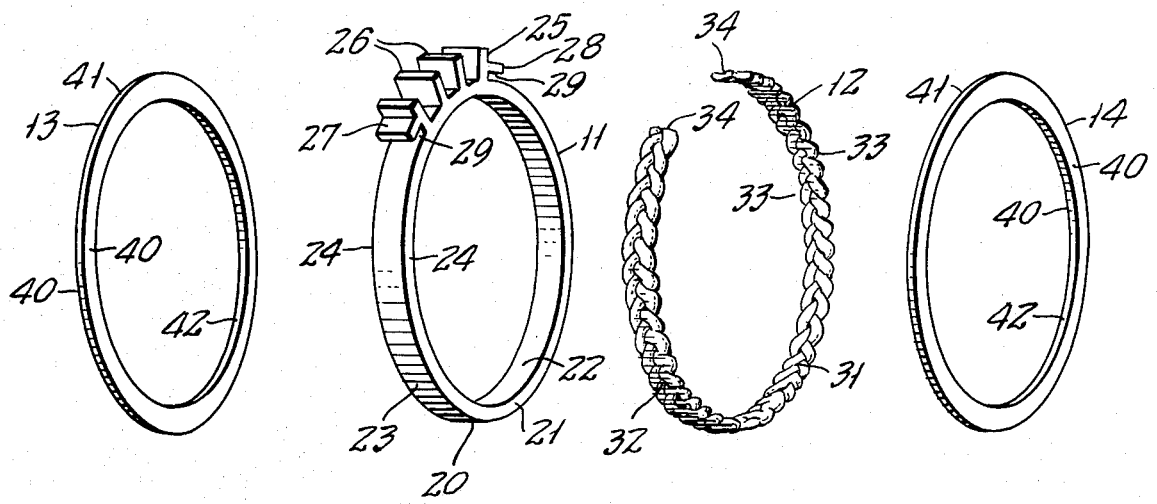
FIG. 1 is an exploded view in perspective of an embodiment of the invention.
Figure 2:
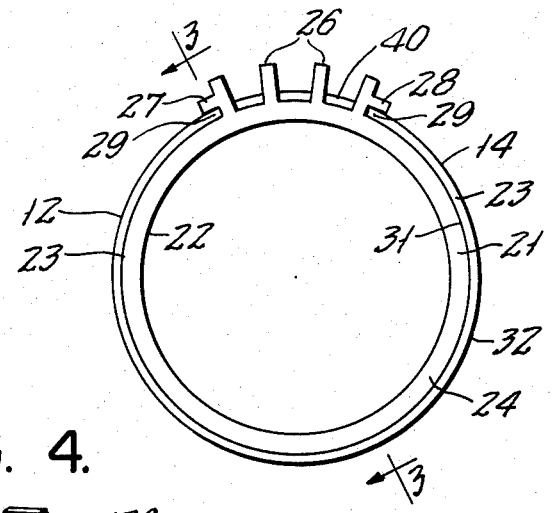
FIG. 2 is a lateral sectional view showing the embodiment in completed condition.
Figure 3:
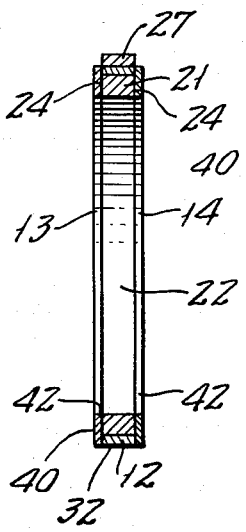
FIG. 3 is a side elevational view thereof.

In accordance with the invention, the device, generally indicated by reference character 10, comprises broadly:

a main body element 11, a decorative strip element 12 and first and second planar ring or disc elements 14.

The main body element 20 will normally be in the form of a solid casting, and includes an annular member 21 bounded by an inner surface 22, an outer surface 23 and end surfaces 24. Preferrably cast integrally with the annular member 21 is a gem stone mounting means 25 including radially extending members 26 adapted to engage and retain a stone. Laterally extending therefrom are a pair of lips 27 and 28 defining channels 29 with the outer surface 23 of the annular member 21, the channels being of a depth sufficient to totally enclose the free ends of the strip element 12.

The strip element 12 is preferrably in the form of a metallic braid, if necessary suitably thinned by a rolling operation prior to installation. It is bounded by an inner surface 31 which abuts the surface 23, and outer exposed surface 32, side edges 33 and end edges 34.

The ring or disc elements 13 and 14 are similar, each being bounded by a pair of opposed planar surfaces 40, an outer peripheral edge 41 and an inner peripheral edge 42. The outer edge is of diameter corresponding to that of the inner surface of the lips 27 and 28, while the inner peripheral edge 42 corresponds to the diameter of the inner surface 22 of the annular member 21.

During assembly, which will normally be prior to the seating of a gem stone (not shown), the decorative strip element 12 is cut to an effective length which will enable the free ends thereof to be seated in the channels 29. Because the edges will be concealed, it will not normally be necessary to solder or fuse the cut strands of metallic thread. The element 12 is then soldered to the outer surface 23 of the annular member 21 using well known techniques. Next the elements 13 and 14 are soldered to the inner surfaces 24 of the annular member 21, and the completed ring is then polished. This assembly will result in the covering of the side edges of the decorative strip by the disc members, and the polishing operation will blend the outer edges 41 with the lips 27 while the inner edge 42 is blended with the inner surface 22.

As a result, only the outer surface of the decorative strip 12 will be exposed to view, and will be effectively shielded from damage resulting from accidental contact therewith during wear.

It will be observed that by resort to the above procedure, a very minimum of soldering need be made to the relatively fragile decorative strip element 12, it being sufficient to merely tack it to the outer surface 22, and rely upon the presence of the lips 27–28 and the ring elements 13 and 14 to overly all of the exposed edges thereof and prevent accidental dislodgment.

Figure 4:
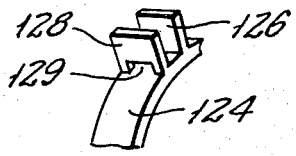
FIG. 4 is a perspective view of an alternate form of the embodiment.

Turning now to the alternate form of embodiment shown in FIG. 4, parts corresponding to those of the principal embodiment have been designated by similar reference characters with the additional prefix "1".

The alternate form 110 differs from the principal form 10 in that the lip 27, is eliminated, and the outermost member 126 is provided with a slotted opening 127, which performs the same function on either side of the gem stone mounting. Thus, the ends 34 of the band 12 are inserted into the openings 127, which form a channel 129.

We wish it to be understood that we do not consider the invention limited to the precise details of structure shown and set forth in this specification, for obvious modifications will occur to those skilled in the art to which the invention pertains.

We claim:

1. An improved ring construction comprising: a base element including a continuous annular member and an integral gem stone mounting on an outer surface of said annular member, said gem stone mounting forming a pair of oppositely disposed lip members forming recesses between said lip members and said outer surface of said annular member; an elongate decorative strip of metallic material mounted upon an outer surface of said annular member and having first and second ends respetively positioned beneath one of said lip members within one of said recesses; and a pair of outer planar ring members of larger diameter corresponding to the effective diameter of said braided material and overlying the longitudinal edges thereof, said ring members being interconnected to lateral edges of said annular member; whereby only an outer planar surface of said decorative strip is exposed to view.

2. Improved ring construction in accordance with claim 1, further characterized in said lips being formed by openings in portions of said gem stone mounting.

3. The method of making a finger ring having a gem stone mounting on an outer surface thereof, and a braided decorative member overlying portions of said ring on either side of said gem stone mounting, comprising the steps of: casting a main body element to include an annular member and an integral gem stone mounting on an outer surface thereof, said mounting including a pair of oppositely disposed lips each defining a channel formed between an undersurface of one of said lips and a respective portion of said outer surface of said annular member; forming an elongated decorative strip of width corresponding to that of said outer surface and of length such that the oppositely disposed ends thereof are seatable within a respective said channel when overlying said outer surface of said annular member; soldering said decorative strip in position upon said outer surface with said ends disposed within said channels; providing a pair of planar ring members of larger diameter corresponding to the outer diameter of said decorative strip, and an inner diameter corresponding to that of the inner diameter of said annular member; and soldering said planar ring members to said annular member to overlie the longitudinal edges of said strip.

4. The method in accordance with claim 3, further characterized in said decorative strip being of braided metallic material.

* * * * *